United States Patent [19]

Shimizu

[11] 4,214,750

[45] Jul. 29, 1980

[54] OCTOPUS CATCHING GAME KIT

[76] Inventor: Takeshi Shimizu, Igusadanchi 8-406, No. 377 Ohaza Igusa, Yashio-shi, Saitama-ken, Japan

[21] Appl. No.: 929,659

[22] Filed: Jul. 31, 1978

[51] Int. Cl.[2] ..... A63F 9/00

[52] U.S. Cl. ..... 273/1 M; 273/140

[58] Field of Search ..... 46/236; 273/1 R, 1 Q, 273/1 S, 139, 140, 273

[56] References Cited

U.S. PATENT DOCUMENTS

| | | | |
|---|---|---|---|
| 1,473,603 | 11/1923 | Anderson | 273/140 |
| 3,053,538 | 9/1962 | Roca | 273/139 |
| 3,545,750 | 12/1970 | Stachnik | 273/140 X |
| 3,844,567 | 10/1974 | Marker | 273/139 |
| 4,039,184 | 8/1977 | Breslow | 273/1 M |

FOREIGN PATENT DOCUMENTS

| | | | |
|---|---|---|---|
| 281177 | 12/1927 | United Kingdom | 273/140 |

*Primary Examiner*—Harland S. Skogquist

*Attorney, Agent, or Firm*—Hill, Van Santen, Steadman, Chiara & Simpson

[57] ABSTRACT

A game kit has octopus-shaped bodies each having a built-in magnet which are set in each of a number of receptacles provided at various positions on a playing surface, each of said octopus-shaped bodies coming up above the surface out of a receptacle at particular time intervals, being pushed upwards by fin-shaped protrusions provided on a disk rotating under the surface, and the octopus-shaped bodies are caught by players who properly operate a magnetized catching pot suspended with string from the end of a fishing rod.

7 Claims, 8 Drawing Figures

FIG. 6
FIG. 7
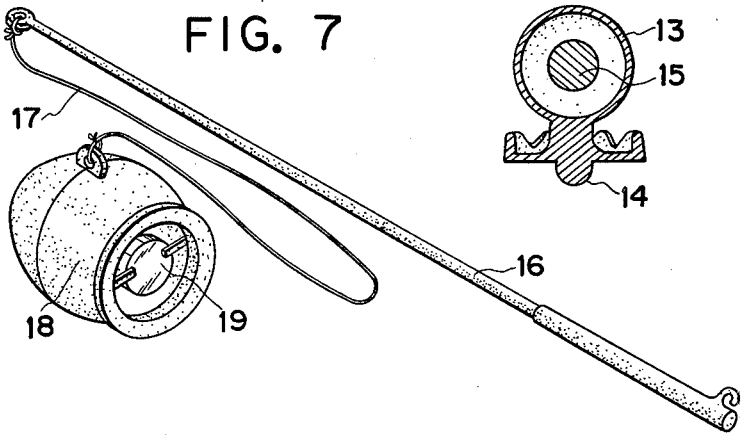
FIG. 8
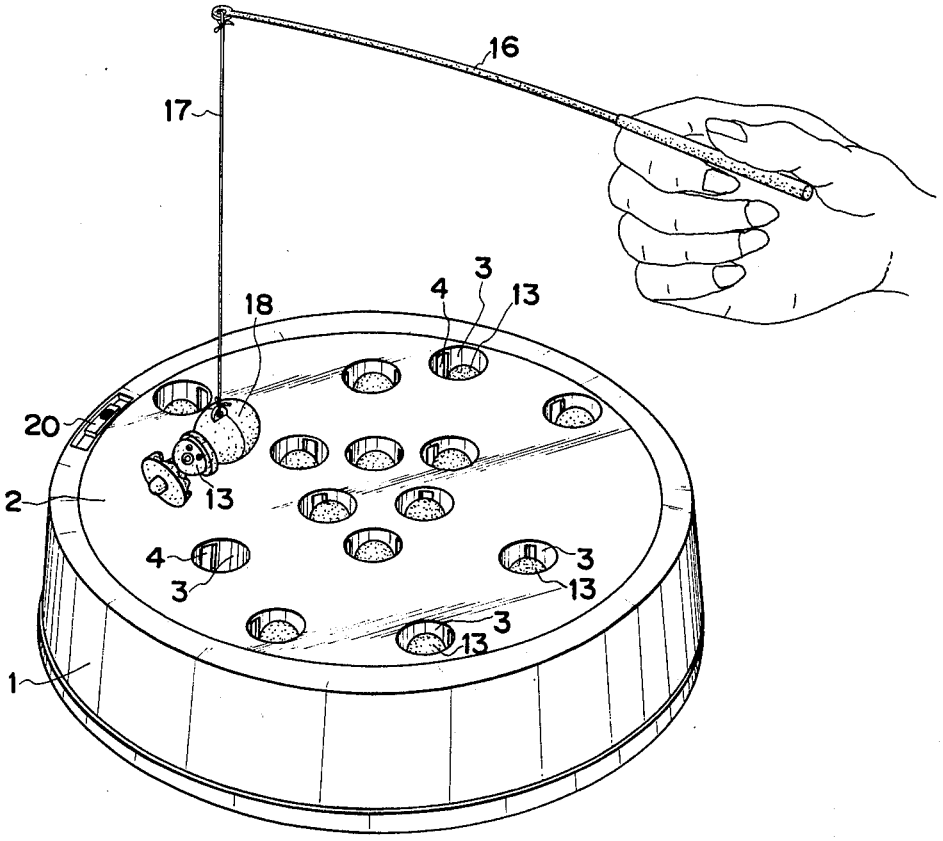

OCTOPUS CATCHING GAME KIT

BACKGROUND OF THE INVENTION

1. Field of the Invention

This invention relates to the field of games, and in particular to a game kit designed to give players the fun of hooking bobbing magnetized animal-like pieces with a magnetic fishing apparatus.

2. Description of the Prior Art

Conventional fishing game kits generally utilized a rotary disk on which magnetized fish-shaped bodies are placed, to be caught and are attracted to a fishing rod with a magnetized attractor or hook suspended from its end with a string. A player catches the fish-shaped bodies by means of the magnetized attractor by operating the fishing rod with the attractor attached or by using a fishing hook suspended from the rod end to pick up the fish-shaped body by catching a hook receiver attached to the body.

As described above, the conventional kits generally move the fish-shaped bodies on a rotary disk so that the players can catch the fish-shaped bodies very easily, and the skills needed to render the game as no longer a challenge are quickly acquired.

SUMMARY OF THE INVENTION

This invention has a plurality of receptacles provided in a top playing surface of a generally cylindrical base in which octopus-shaped bodies with built-in magnet are received. Sloping fin-shaped protrusions fixed forming segments of concentric circles are to a rotary board mounted under the top board and are rotated through slots in the receptacles. The fins engage their upsloping edges with the octopus-shaped bodies to momentarily push the bodies out of the receptacle, and subsequently allow the bodies to fall vertically along their end vertical edges. Therefore, if an octopus-shaped body coming up out of a receptacle is not picked up quickly by a player manipulating a magnet provided in a pot-shaped container suspended from the end of fishing rod, the octopus soon falls back into the receptacle. Moreover, the player does not know out of what receptacles among a number of such receptacles an octopus will make its appearance next. Because of such factors, it is not easy for the player to pick up an octopus. The invention thus provides a challenge to players which makes the game more enjoyable.

BRIEF DESCRIPTION OF THE DRAWINGS

FIG. 6 is a vertical section of FIG. 5,

FIG. 7 is a perspective view of the catching pot that is connected with string to the end of the fishing rod of this invention, and FIG. 8 is a perspective view of this octopus catching game being played.

DETAILED DESCRIPTION OF THE PREFERRED EMBODIMENT

Figure 1:
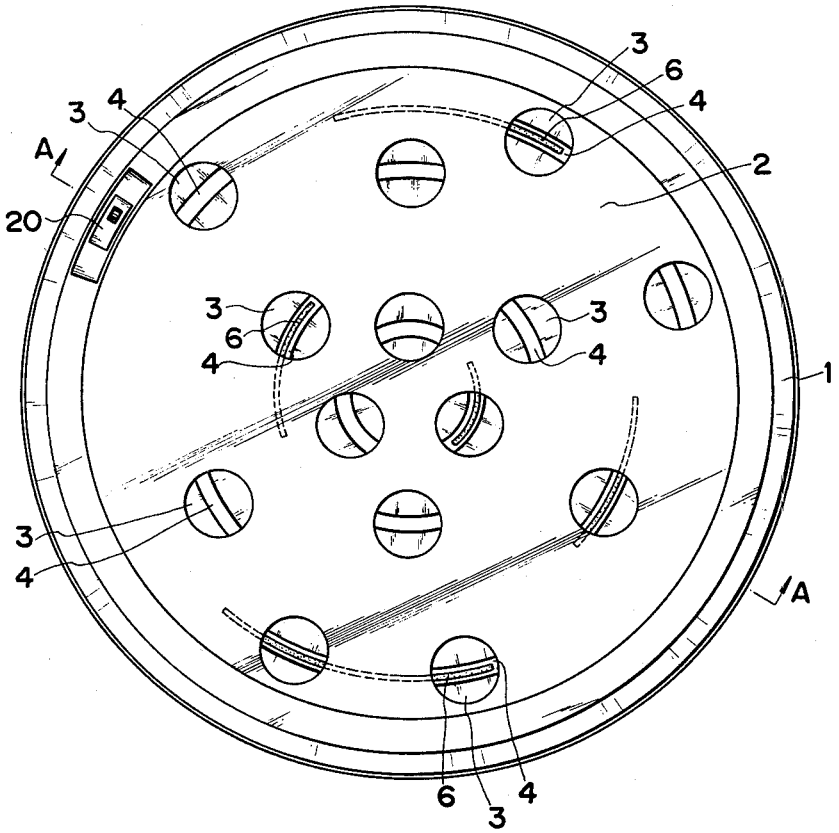
FIG. 1 is a plan view of this invention.
Figure 2:
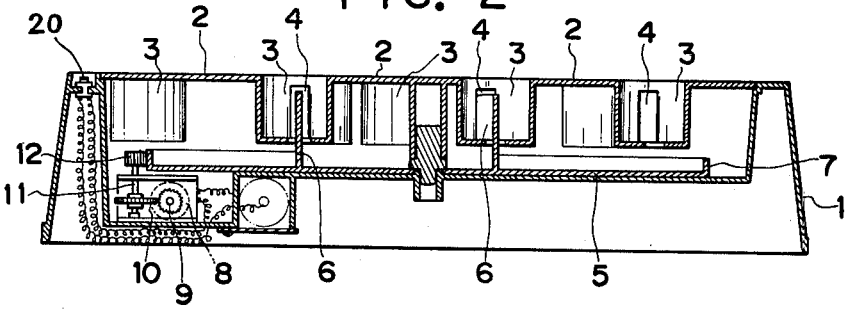
FIG. 2 is a sectional view taken along line A—A of FIG. 1.
Figure 3:
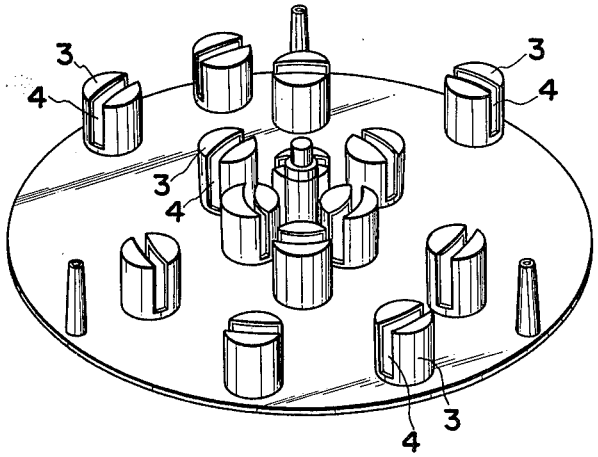
FIG. 3 is a perspective view of the top board viewed up-side down.
Figure 4:
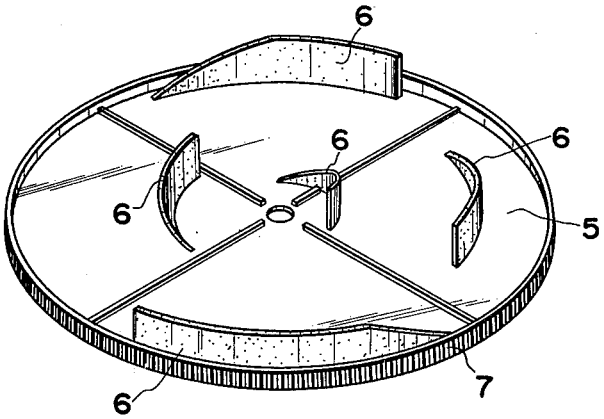
FIG. 4 is a perspective view of the rotary disk provided under the top board.

The elements of this invention are described hereunder in details with reference to the figures.

This invention is provided cylindrical receptacles 3 having centers disposed on a number of concentric circles which have varied radii with a common center at the center of a top-board 2 covering a cylindrical base 1. In the lower portion of each receptacle 3, a vertical slot 4 is provided along the above-mentioned concentric circles, so as to intersect the center of each receptacle and divide the receptacle into two sections. Under the top-board 2 in the base 1 is provided a rotary board 5 which rotates with its center in common with that of the above-mentioned top-board 2. On the rotary board 5 are set, along the same concentric circles as the slots in the receptacles 3, an optional number of fin-shaped push-up pieces 6, that are sloped upwards on one side and terminate vertically downward from the end point of said slope or from the end of a length of a horizontal section after the slope top, so as to permit passage of the pieces through the slots 4 in the receptacles 3 provided in the top-board 2.

Around the rotary board 5, there are provided small carved gear teeth 7. At a corner of the base 1, there is mounted a battery driven motor 8 operable by a switch 20. The revolution of the rotary axle 9 of motor 8 is transmitted to the vertical axle 11 through a worm gear 10. A head gear 12 is provided on the vertical axle 11 to mesh with the teeth 7 on the rotary board 5 to rotate this board.

Figure 5:
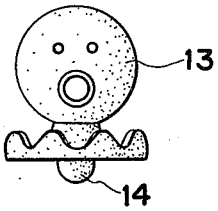
FIG. 5 is a front view of octopus-shaped body.

An octopus-shaped body 13, as shown in FIG. 5, the receptacle is inserted in 3, and a has protrusions 14 on its bottom face and magnet 15 in the interior of the body 13. And octopus-catching pot 18 is connected with string 17 to the end of a fishing rod 16 and has in an indentation on the bottom thereof 19.

Play with this kit is made along the following steps: Octopus-shaped bodies 13 are put in each receptacle. The switch 20 is moved to set in motion motor 8 and the rotary board 5 starts of rotate. A push-up fin-shaped piece 6 located on the surface of rotary board 5 proceeds into a slot 4 in one of the receptacles 3 with its sloped edge side faced forward and pushes up the octopus-shaped body 13. The octopus-shaped body 13 tilts to either the right or left as the protrusion 14 located on the bottom face is a pushed foreward by the sloped edge of push-up fin-shaped piece 6, and goes upward over the surface level of top-board 2, guided by the inside wall of the receptacle 3. At this moment, if a fishing rod 16 is so operated that the catching pot 18 is near the head center of the octopus-shaped body 13 with the inside of catching pot 18 faced toward octopus-shaped body 13, the octopus-shaped body 13 will be caught in the indented part of the fishing pot 18 by the attraction force between magnet 19 set inside catching pot 18 and magnet 15 set inside the head section of octopus-shaped body 13. Then, with fishing rod 16 moved upward, the octopus-shaped body 13 is pulled up, as a success of fishing, from the dented hole 3. At this time, however, if the catching pot 18 is facing backwards against the targeted octopus-shaped body 13, the fishing attempt will end in failure and if the fishing rod 16 is not moved in a considerably quick motion, the octopus also will not be caught easily since the octopus suddenly falls down into its receptacle 3 upon the fin-shaped piece 6 passing through the slot 4 even though the octopus body is rather slow in its up-rising motion. Furthermore, this invention has at optional points in the top-board the push-up fin-shaped pieces 6 which are fewer in number than that of receptacles holes 3. Therefore, the player does not know in advance which receptacle 3 out of which an octopus-shaped body will come up next. The protrusion 14 that each octopus-shaped body 13 has on its bottom face causes the octopus to be tilted to the front, rear, right or left and thus adds to the difficulty of octopus catching.

I claim as my invention:

1. A game kit for simulating the sport of fishing, said kit comprising:

a generally cylindrical base having a central vertical access;

a horizontal flat circular playing surface disposed on said base, said playing surface having a plurality of cylindrical receptacles therein, each said receptacle having a center disposed on a circle concentric with said playing surface and each receptacle further having a vertical slot in a lower portion thereof, each said slot forming a segment of the circle on which said receptacle center is disposed;

a rotary board disposed beneath and concentric with said playing surface for rotation about said vertical access;

a means for rotating said rotary board;

a plurality of vertical upwardly sloping fins mounted on said rotary board, each said fin forming a segment of a circle concentric with said playing surface and disposed to move through a respective one of said slots, and each said fin terminating in a downwardly extending edge;

a plurality of magnetized playing pieces respectively slidably received in said receptacles;

a magnetized playing piece attractor which can be manipulated by a player to remove a playing piece from a receptacle by magnetic attraction therebetween, whereby rotation of said rotary board causes said fins to move through said slots to momentarily push a playing piece above said playing surface during which time the playing piece may be attracted to said playing piece attractor, and said playing piece rapidly falling below said playing surface as said downwardly extending edge of said fin passes through a slot in the receptacle containing said playing piece.

2. The game kit of claim 1 wherein said means for rotating said rotary board comprises:

a motor having a horizontal drive shaft with a gear corotatably mounted thereon;

a vertical shaft having a worm at a lower end thereof which meshes with said gear on said drive shaft, and having a head gear on an upper end thereof;

a plurality of gear teeth mounted on the periphery of said rotary board, said gear teeth meshing with said head gear on said vertical shaft, whereby rotation of said drive shaft transmits rotary motion to said worm which in turn rotates said head gear to rotate said rotary board.

3. The game kit of claim 1 wherein each said playing piece has a downwardly extending protrusion on a bottom thereof, for engagement with a fin to tilt said playing piece as it emerges from said receptacle.

4. The game kit of claim 1 wherein each fin has an upwardly sloping leading edge followed by a horizontal midsection and terminates in a vertical edge disposed at a right angle to said horizontal midsection.

5. The game kit of claim 1 wherein each said fin has an upwardly sloping leading edge followed immediately by a downwardly sloping lagging edge.

6. The game kit of claim 1 wherein each said fin has a series of undulations to repeatedly raise and lower said playing piece in said receptacle as said fin moves through said slot.

7. The game kit of claim 1 wherein each said playing piece is shaped to resemble an octopus, and said playing piece attractor is a miniature fishing rod having a string attached at one end thereof and a catching-pot having an exposed magnet mounted therein attached to said string for suspension above a playing piece for attracting the playing piece.

* * * * *

UNITED STATES PATENT AND TRADEMARK OFFICE

CERTIFICATE OF CORRECTION

PATENT NO. : 4,214,750

DATED : July 29, 1980

INVENTOR(S) : Takeshi Shimizu

It is certified that error appears in the above—identified patent and that said Letters Patent is hereby corrected as shown below:

In column 1, line 33 cancel "fixed"; and in line 34, insert -- fixed -- following "are".

In column 2, line 38 insert -- an exposed magnet -- following "thereof".

In column 2, line 48, cancel "a"; and in line 49 insert -- a -- following "of".

Signed and Sealed this

*Fourth* Day of *August 1981*

[SEAL]

*Attest:*

GERALD J. MOSSINGHOFF

*Attesting Officer*

*Commissioner of Patents and Trademarks*